US005492295A

United States Patent [19]

Remmers

[11] Patent Number: 5,492,295

[45] Date of Patent: Feb. 20, 1996

[54] HANG ROD MOUNTING BRACKET

[75] Inventor: Lee Remmers, Oscala, Fla.

[73] Assignee: Vermont American Corporation, Louisville, Ky.

[21] Appl. No.: 255,245

[22] Filed: Jun. 7, 1994

[51] Int. Cl.[6] ..... A47H 1/14

[52] U.S. Cl. ..... 248/251; 211/105.1; 211/123

[58] Field of Search ..... 248/251; 211/123, 211/105.1, 113, 106; 108/29

[56] References Cited

U.S. PATENT DOCUMENTS

| | | | |
|---|---|---|---|
| 3,765,634 | 10/1973 | Stempel | 248/250 |
| 3,990,582 | 11/1976 | Schindel | 248/251 X |
| 4,316,593 | 2/1982 | Miner et al. | 248/250 |
| 4,374,498 | 2/1983 | Yellin | 248/250 |
| 4,426,057 | 1/1984 | Nudo | 211/105.1 X |
| 4,493,423 | 1/1985 | Kaeslin | 108/29 X |
| 4,762,238 | 8/1988 | Blanchard | 211/123 |
| 5,351,842 | 10/1994 | Remmers | 211/123 X |
| 5,405,026 | 4/1995 | Lee | 211/106 X |
| 5,415,299 | 5/1995 | Usner | 211/113 X |

*Primary Examiner*—J. Franklin Foss

*Attorney, Agent, or Firm*—Middleton & Reutlinger; Charles G. Lamb

[57] ABSTRACT

A hang rod mounting bracket includes a front section and back section hingedly attached thereto. The front section and the back section include in registration recesses defining openings therein to receive shelf support bars and a hang rod therethrough in parallel. The hang mounting bracket also includes slots in registration in each section to receive stringer wires therein.

6 Claims, 7 Drawing Sheets

HANG ROD MOUNTING BRACKET

BACKGROUND OF THE INVENTION

This invention relates to a hang rod mounting bracket for attaching a hang rod to a shelf. More particularly, this invention relates to a hang rod mounting bracket with improved means for attaching a hang rod to a wire shelf which may be attached to a wall by a support brace assembly.

There are many attaching devices for attaching or mounting a wire shelf which is made up of a plurality of spaced parallel horizontal stringers and vertically spaced support bars or rods wherein the stringers and bars are in perpendicular relation. For example, U.S. Pat. No. 3,765,634 teaches a joiner support for joining together open shelves by fastening together two shelf halves about rods of the shelves wherein the rods extend through openings in the shelf halves and are braced within the shelf halves to help stabilize the shelves. The joiner support can be braced against a wall with a bracket. U.S. Pat. No. 4,374,498 and U.S. Pat. No. 4,316,593 also teach support and connecting devices for wire shelving.

SUMMARY OF THE INVENTION

It is an object of the present invention to provide a hang rod mounting bracket for joining hang rods to shelves.

Another object of the present invention is to provide a hang rod mounting bracket which helps stabilize shelves constructed of parallel wires or stringers.

A further object of the present invention is to provide a hang rod mounting bracket which may be-utilized to join shelves and/or hang rods together.

Still another object of the present invention is to provide a hang rod mounting bracket which may be attached to a support brace assembly which is mounted to a wall, or a pole which goes to the floor.

More particularly, the present invention is directed to a hang rod mounting bracket comprising:

a front section hingedly attached to a back section, said front section and said back section having means to receive two shelf support bars and a hang rod therethrough, said support bars and said hang rod being in spaced parallel relation; means to align said front and said back sections; and, means to attach said front and said back sections together.

In accordance with these and other objects which will become apparent upon reading the details provided hereinafter, the present invention will now be described with particular reference to the accompanying drawings and the numbers associated therewith identifying the particular parts of the invention.

DETAILED DESCRIPTION OF THE PREFERRED EMBODIMENT

Figure 1:
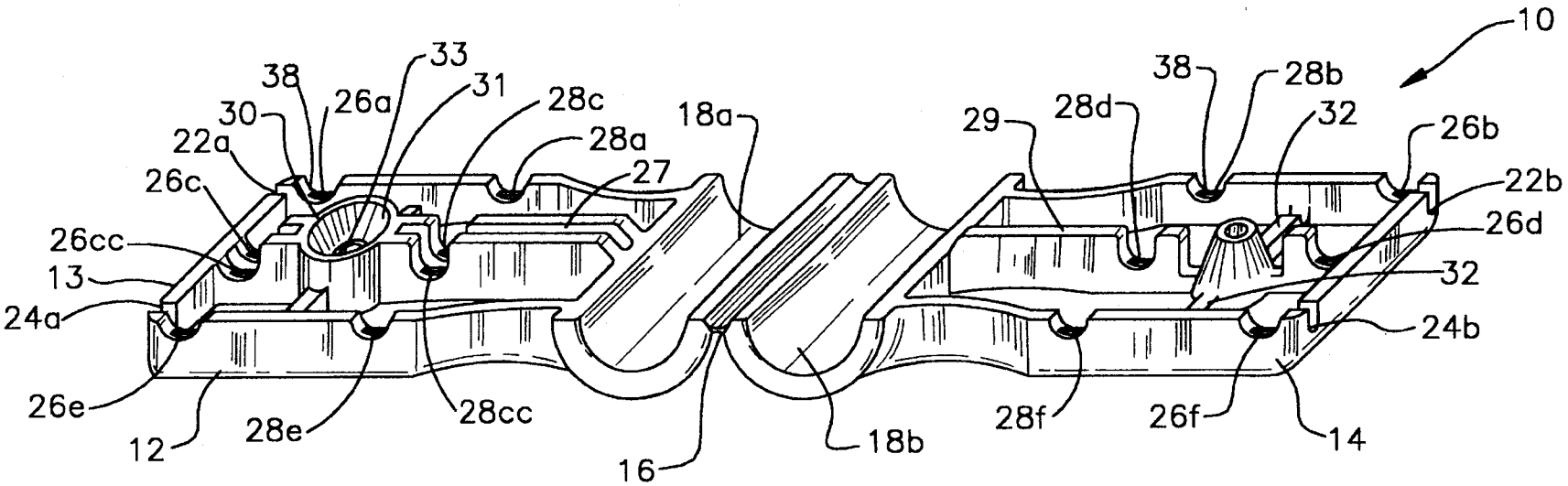
FIG. 1 is a perspective view of a preferred hang rod mounting bracket of the present invention shown in an open position.
Figure 5:
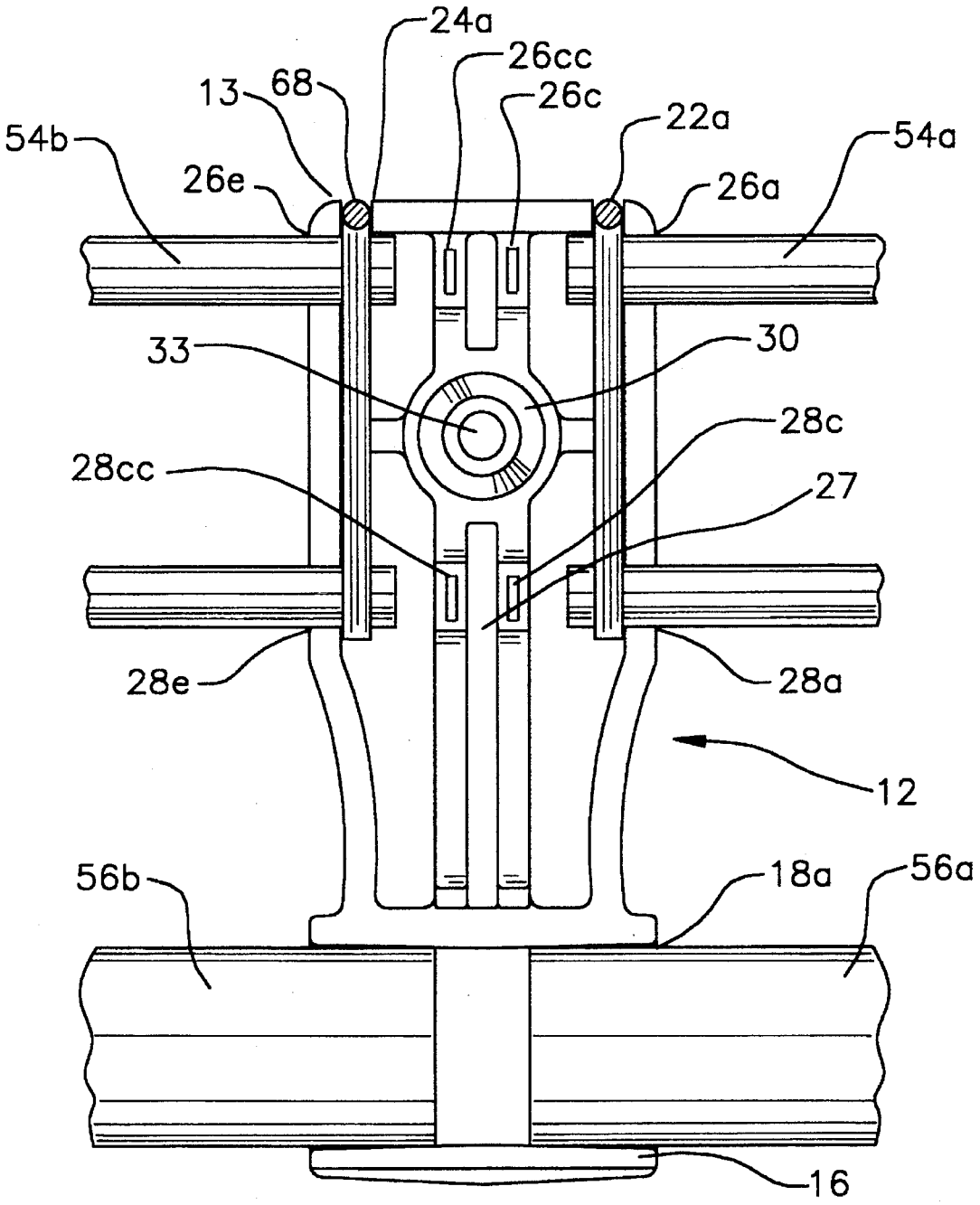
FIG. 5 is a top end view of the back section of FIG. 4.
Figure 6:
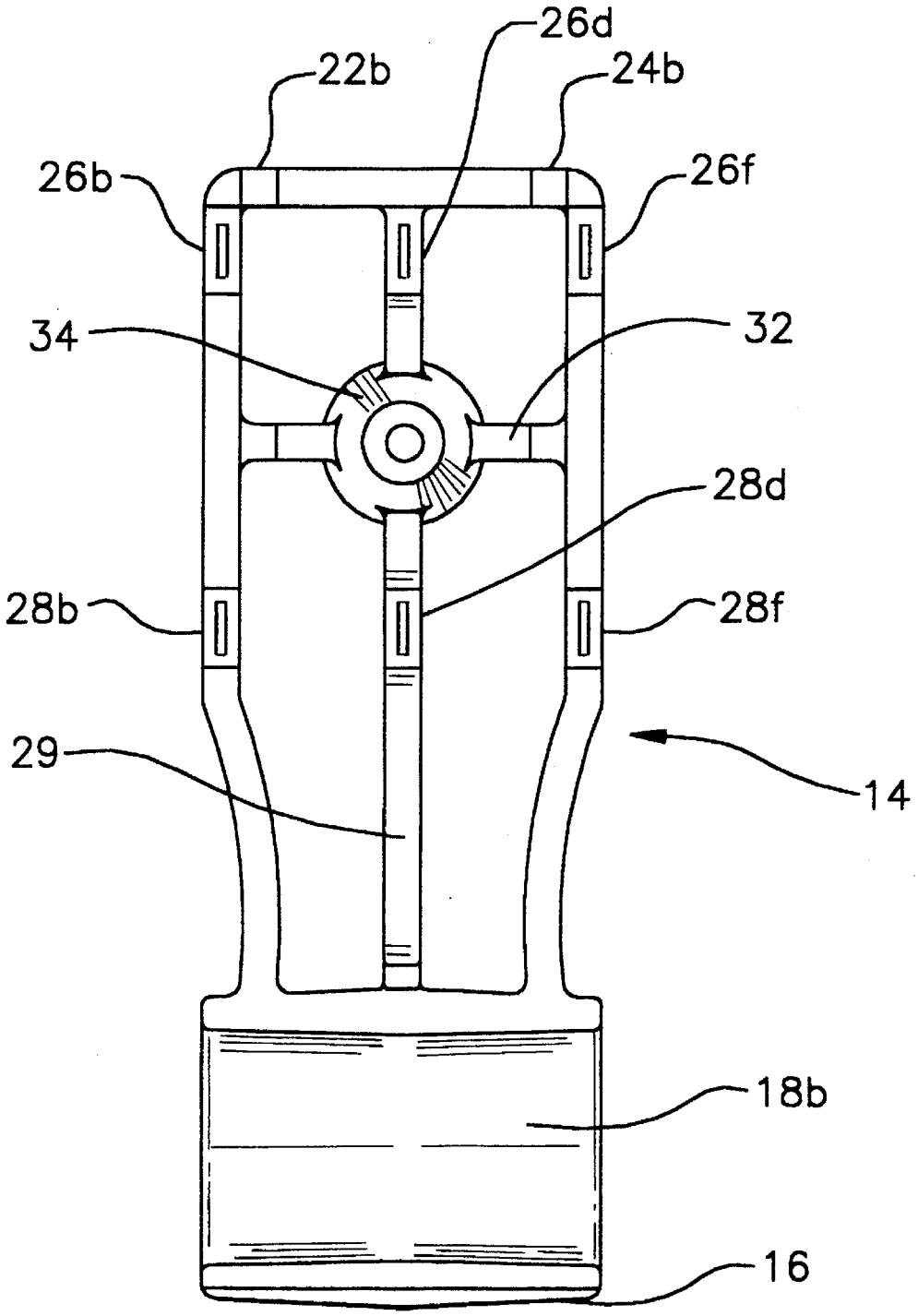
FIG. 6 is a top end view of the front section of FIG. 4.

Referring particularly to FIGS. 1, 5, and 6, a preferred hang rod mounting bracket 10 of the present invention is shown. The mounting bracket 10 is generally of unitary construction with a back section 12 and a front section 14 hingedly attached by hinge 16. The hang rod mounting bracket 10 is usually of plastic construction with the hinge 16 being a very thin strip connecting the back section 12 with the front section 14.

The back section 12, at its upper end 13, includes a pair of horizontally extending slots 22*a* and 24*a* therein to receive stringers 68 (FIGS. 2 and 2*a*) therethrough. The slots 22*a* and 24*a* are in registration with vertically extending slots 22*b* and 24*b* in front section 14 which also receive stringers 28 therein.

Figure 2:
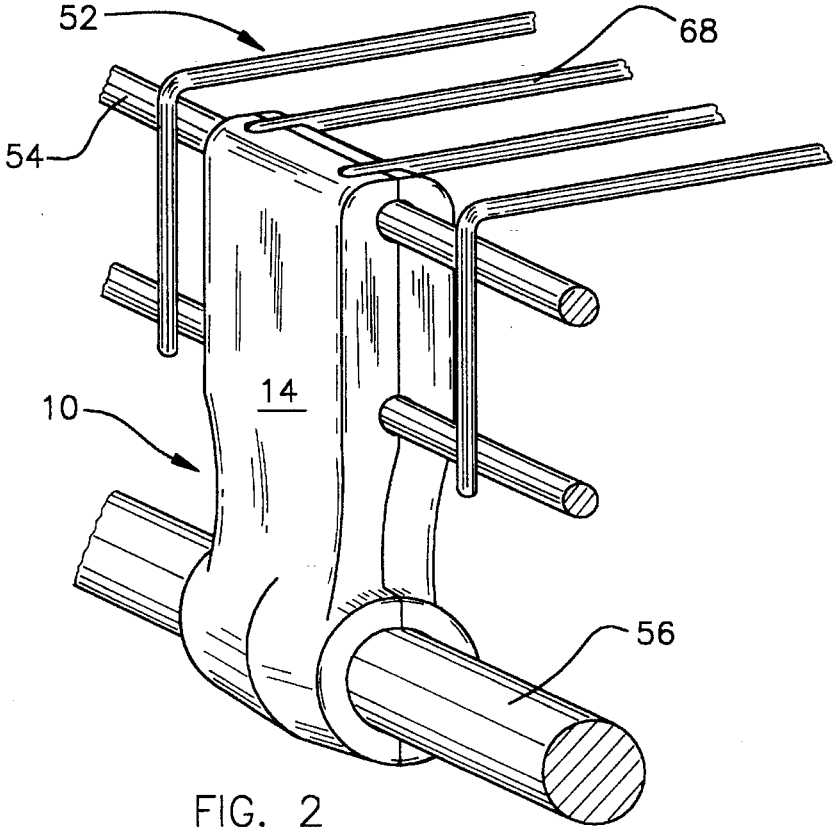
FIG. 2 is a front perspective view of the preferred hang rod mounting bracket in a closed position with a shelf.
Figure 2A:
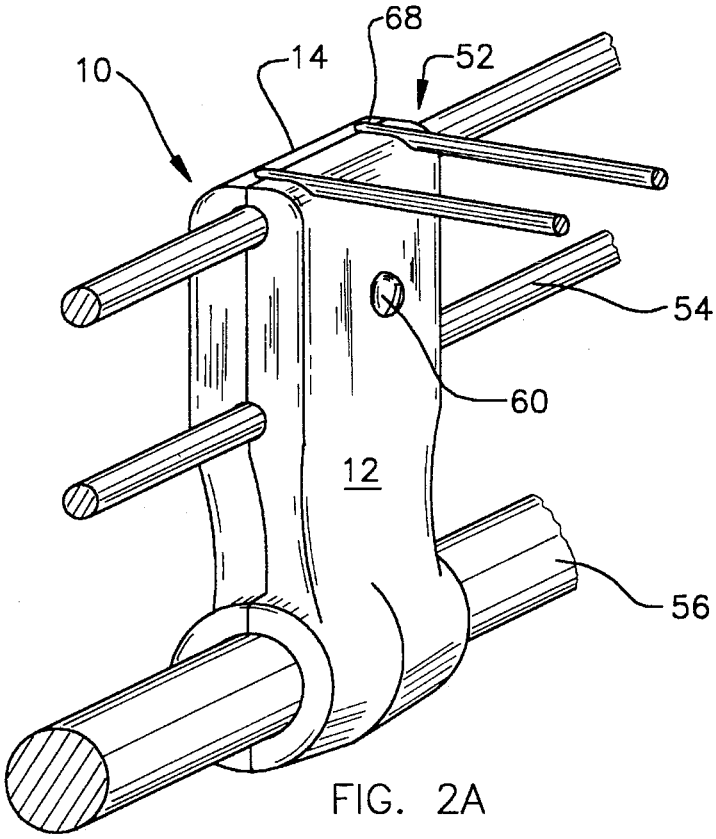
FIG. 2*a* is a back perspective view of the preferred hang rod mounting bracket in a closed position with a shelf.

The back section 12 is also provided with a plurality of aligned recesses 26*a*, 26*c*, 26*cc* and 26*e* to receive a support bar 54 of a shelf 52 as seen in FIGS. 2 and 2*a*. Back section 12 also includes another alignment of recesses identified by numerals 28*a*, 28*c*, 28*cc* and 28*e* therein to receive a second support bar 54. The alignment of the recesses 28*a*, 28*c*, 28*cc* and 28*e* are aligned so that support bar 54 received therein is parallel to the support bar 54 which is received within the recesses 26*a*, 26*c*, 26*cc*, and 26*e*. The aforementioned recesses 26 and 28 are generally semi-cylindrical in shape.

The front section 14 also includes aligned recesses 26*b*, 26*d*, and 26*f* which are also semi-cylindrical in configuration. When the front section 14 and the back section 12 are in a closed position, the semi-cylindrical recesses in each section are in registration with recesses in the other section. For example, recess 26*a* is in registration with recess 26*b* to form an opening therebetween. Recess 26*b* is positioned between recesses 26*c* and 26*cc*. Recess 26*e* is in registration with recess 26*f* to define an opening therethrough.

Recesses 28*b*, 28*d*, and 28*f* are also provided in front section 14 for registration with recesses 28*a*, 28*c*, 28*cc* and 28*e* in back section 12 in the same manner as recesses 26*a*, 26*b*, 26*c*, 26*cc*, 26*d*, 26*e*, and 26*f*.

Each of the front and back sections 14 and 12, respectively, are provided with registering semi-cylindrical hang rod retainers 18*a* and 18*b* which in a closed position form a cylindrical hang rod support and retainer.

The hang rod mounting bracket 10 is also provided with a tongue and groove connection for aligning the back section with the front section. As shown, the groove portion 27 is disposed in the back section 12 and the tongue 29 is longitudinally extending of the front section 14. When the hang rod mounting bracket 10 is in a closed position the tongue 29 is received within the groove 27.

Figure 4:
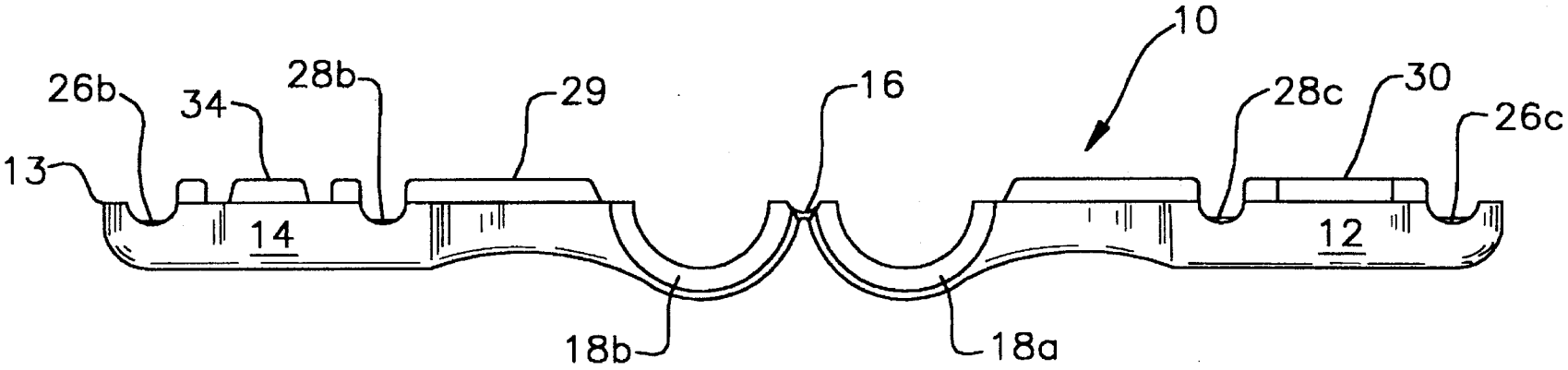
FIG. 4 is an elevational view of the mounting means of FIG. 1 in an open position.

The hang rod mounting bracket 10 is also provided with means to receive a screw 60 therethrough to hold the front and back sections together. As best shown in FIGS. 1, 4, and 5 the back section 12 includes a conical-shaped receiving collar 30 having an opening 33 therethrough and a recess therearound. The screw 60 is received through said opening 33. The front section 14 is provided with a conical shaped screw connector 34 which receives an end of the screw 60 therein. The conical-shaped screw connector 34 is received within recess 31 around the conical-shaped receiving collar 30 when the bracket 10 is in a closed condition. Transverse wire retaining ribs 32*a* and 32*b* are provided in the front section 14 for maintaining the stringers 50 in secured condition therein when the hang rod mounting bracket 10 is in the closed condition.

Figure 3:
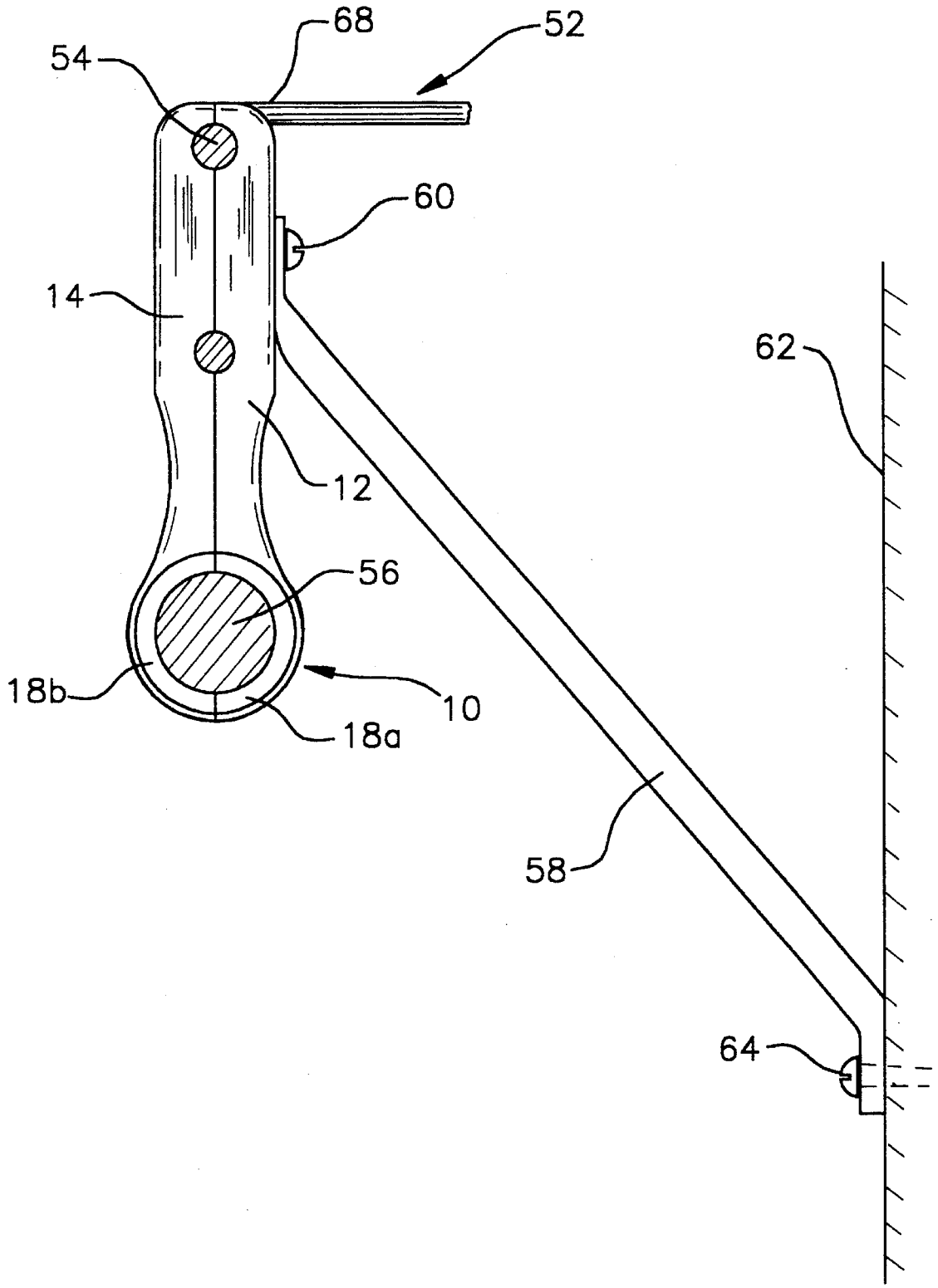
FIG. 3 is a side view of a hang rod mounting means attached to a wall support.

As shown in FIG. 3, the hang rod mounting bracket 10 may also be supported by a wall 62 with the use of a wall support brace member 58. One end of the support wall brace 58 is mounted to the hang rod mounting bracket 10 by the screw 60 and the opposite end of the wall support brace 58 is attached to wall 62 by a mounting screw 64.

Figure 3A:
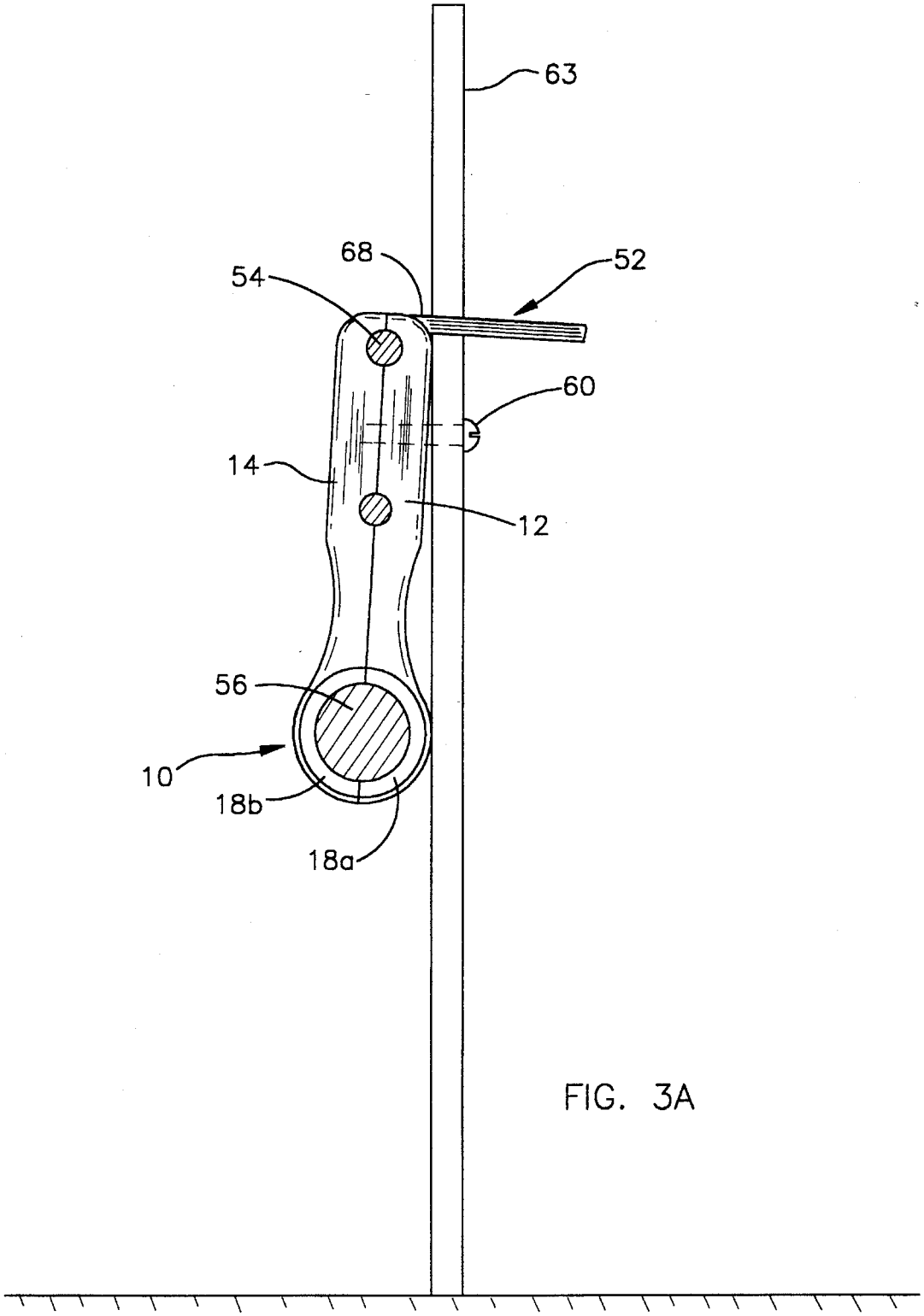
FIG. 3*a* is a side view of a hang rod mounting means attached to a pole support to a floor.

As shown in FIG. 3*a*, the hang rod mounting bracket 10 may be supported by an elongated vertically extending pole 63. Pole 63 is generally mounted to a floor and extends upwardly towards, and may engage a ceiling. The screw 60 is received within a pair of spaced aligned apertures (not shown) in pole 63 and the mounting bracket opening 30 (FIG. 1).

In operation, the hang rod mounting bracket 10 receives the parallel support bars 54 transversely therethrough and a hanger rod 56 is received within the semi-cylindrical hang rod retainers 18*a*, 18*b* in parallel with bars 54. Moreover, the stringers 68 are received within the mating slots 24*a, b, c,* and *d* and extend longitudinally of the hang rod mounting bracket 10. It is also realized that the hang rod mounting bracket may be used to attach shelves in end-to-end relation. For example, as shown in FIG. 5, a support bar 54*a* of one shelf is received within recesses 26*a* and 26*b* (FIG. 6) and in axial alignment therewith, a support bar 54*b* from a second shelf is received within recesses 26*e* and 26*d* (FIG. 6). Moreover, two hang rods may also be mounted in end-to-end relation by the hang rod mounting bracket 10. As shown in FIG. 5, two hang rods 56*a* and 56*b* are placed end-to-end within the semi-cylindrical hang retainers 18*a*. Upon closure of the back and front sections 12 and 14, respectively, of the hang rod mounting bracket 10, the two hang rods 56*a* and 56*b* are held in place.

It is realized that various changes in the details, materials of construction, steps and arrangements of the parts which have been described herein as shown in the drawings in order to explain the nature of the invention, may be made by those skilled in the art without departing from the principals and scope of the invention as expressed in the claims appended hereto.

What is claimed is:

1. A hang rod mounting bracket comprising:

a front section hingedly attached to a back section; said front section and said back section having co-operating means to receive two shelf support bars and a hang rod therethrough, said hang rod and said support bars being in spaced parallel relation;

means to align said front section to said back section;

means to attach said front section to said back section; and means to attach said hang rod mounting bracket to a support brace.

2. The bracket of claim 1 including means to receive one end of at least two shelf-wire stringers therein.

3. The bracket of claim 1 including means to attach two shelf sections together in an end-to-end relation.

4. The bracket of claim 1 wherein said means to align said front and said back sections is a tongue and groove connection, said tongue being longitudinally disposed in one section, said groove being longitudinally disposed in the other section and in alignment with said tongue.

5. The hang rod mounting bracket of claim 1, said means to attach said back section to said front section is a conical-shaped collar having a recess therearound in one of said sections and in registration therewith a conical-shaped connector in the other of said sections.

6. The bracket of claim 5, said collar and said connector having aligned openings therein to receive a screw attaching means therethrough.

* * * * *